United States Patent [19]

List et al.

[11] 4,090,363

[45] May 23, 1978

[54] DAM OF EARTH OR ROCK FILL HAVING IMPERVIOUS CORE

[75] Inventors: Franz List, Hausham; Franz Scheul, Munich, both of Germany

[73] Assignee: Heilmann & Littmann, Bau-Aktiengesellschaft, Munich, Germany

[21] Appl. No.: 641,175

[22] Filed: Dec. 16, 1975

[30] Foreign Application Priority Data

| | | |
|---|---|---|
| Dec. 17, 1974 | Germany | 2459691 |
| Oct. 24, 1975 | Germany | 2547717 |

[51] Int. Cl.[2] ..... E02B 7/00

[52] U.S. Cl. ..... 61/31; 61/30

[58] Field of Search ..... 61/31, 32, 33, 30, 35, 61/1 R

[56] References Cited

U.S. PATENT DOCUMENTS

| | | | |
|---|---|---|---|
| 1,988,777 | 1/1935 | Bohrisch | 61/31 |
| 1,997,132 | 4/1935 | Collorio | 61/31 |
| 2,782,605 | 2/1957 | Wertz et al. | 61/53.64 X |
| 2,863,291 | 12/1958 | Murmann | 61/31 |
| 3,188,814 | 6/1965 | Rettig | 61/31 |
| 3,250,075 | 5/1966 | Webb et al. | 61/39 |
| 3,385,068 | 5/1968 | Armentrout | 61/1 R |
| 3,582,375 | 6/1971 | Tragesser | 61/35 X |

FOREIGN PATENT DOCUMENTS

| | | | |
|---|---|---|---|
| H217,10 | 11/1956 | Germany | 61/31 |
| 2,111,034 | 10/1972 | Germany | 61/31 |
| 312,082 | 2/1956 | Switzerland. | |
| 457,300 | 7/1968 | Switzerland. | |

*Primary Examiner*—Dennis L. Taylor
*Attorney, Agent, or Firm*—Hans Berman

[57] ABSTRACT

A dam of earth or rock fill is provided with an impervious core by forming a trench near the center of the fill and sequentially building plate-shaped wall sections in the trench from poured soil-cement mixture. The wall sections which are superimposed on each other in edge-to-edge relationship are hingedly connected by joint assemblies of tough, yieldable material, such as soil-cement enriched with bentonite.

14 Claims, 15 Drawing Figures

Fig. 2
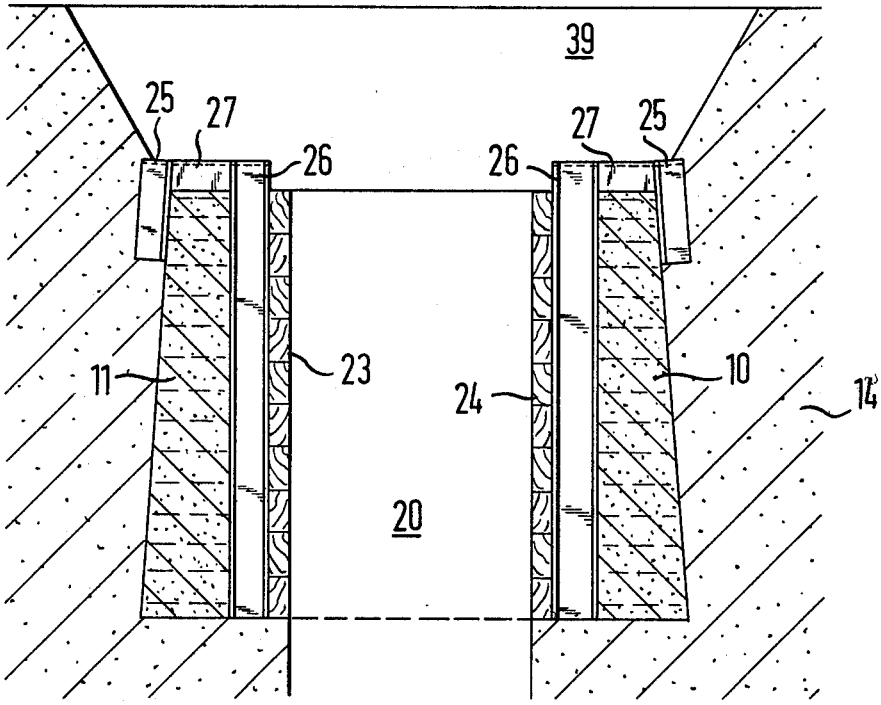
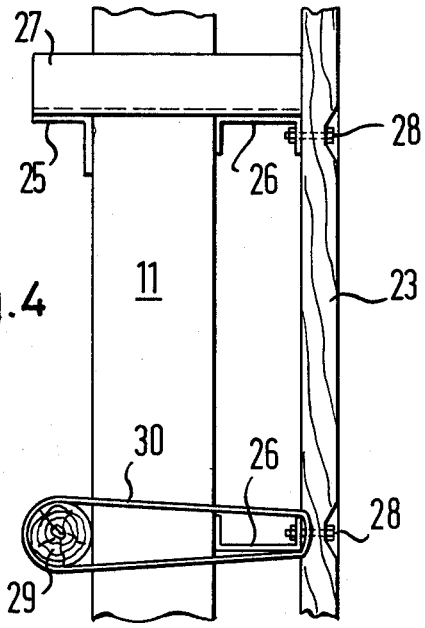
Fig. 4

DAM OF EARTH OR ROCK FILL HAVING IMPERVIOUS CORE

This invention relates to dams for retaining a body of water, and particularly to a dam of earth or rock fill having an impervious core and to a method of building the dam.

Dams consisting of particulate fill are permeable to water to a degree not usually tolerable. It has been proposed, therefore, to provide dams of fill material with an impervious core of different material. The combination of different materials presents serious problems, and the construction of an impermeable seal between the core and an impervious foundation is often difficult.

Difficulties often arise because of the stresses, especially shear stresses, transmitted to the core by the fill as the latter settles on either side of the core. Cracks formed in the fill are sometimes propagated into the core.

It is a primary object of the invention to provide an impervious core for a dam otherwise consisting of particulate fill which may be installed after the fill has practically completed its settling movements. Another object is the provision of an impervious core capable of participating in minor displacement of the fill without suffering damage and a loss of impermeability.

These objects are achieved, according to the invention, in a dam in which a plate-shaped, impervious core extends upward from a foundation substantially impervious to water. Particulate fill resting on the foundation covers the major, vertically extending faces of the core which preferably includes a plurality of superposed wall sections and joint assemblies which connect each wall section to a superposed section for limited pivotal movement.

In constructing the dam briefly described above, particulate fill is deposited on a foundation impervious to water. A trench is excavated in the fill to the foundation, and plate-shaped wall sections are sequentially built in the trench. Each wall section is being built by pouring an aqueous slurry into the trench, the solids in the slurry consisting essentially of particulate filler material and an amount of Portland cement sufficient to cause spontaneous solidification of the slurry. The slurry intended to constitute the lowermost wall section is poured on the foundation, and each subsequent section is poured on the top edge portion of a previously poured and solidified section.

Additional features, other objects, and many of the attendant advantages of this invention will readily be appreciated as the same becomes better understood by reference to the following detailed description of preferred embodiments when considered in connection with the appended drawing in which:

FIG. 2 shows a portion of the dam of FIG. 1 during an early stage of construction in side elevational section on a scale greater than that of FIG. 1;

FIG. 4 is a fragmentary top plan view of the structure of FIG. 2 on a further enlarged scale;

Figure 8:
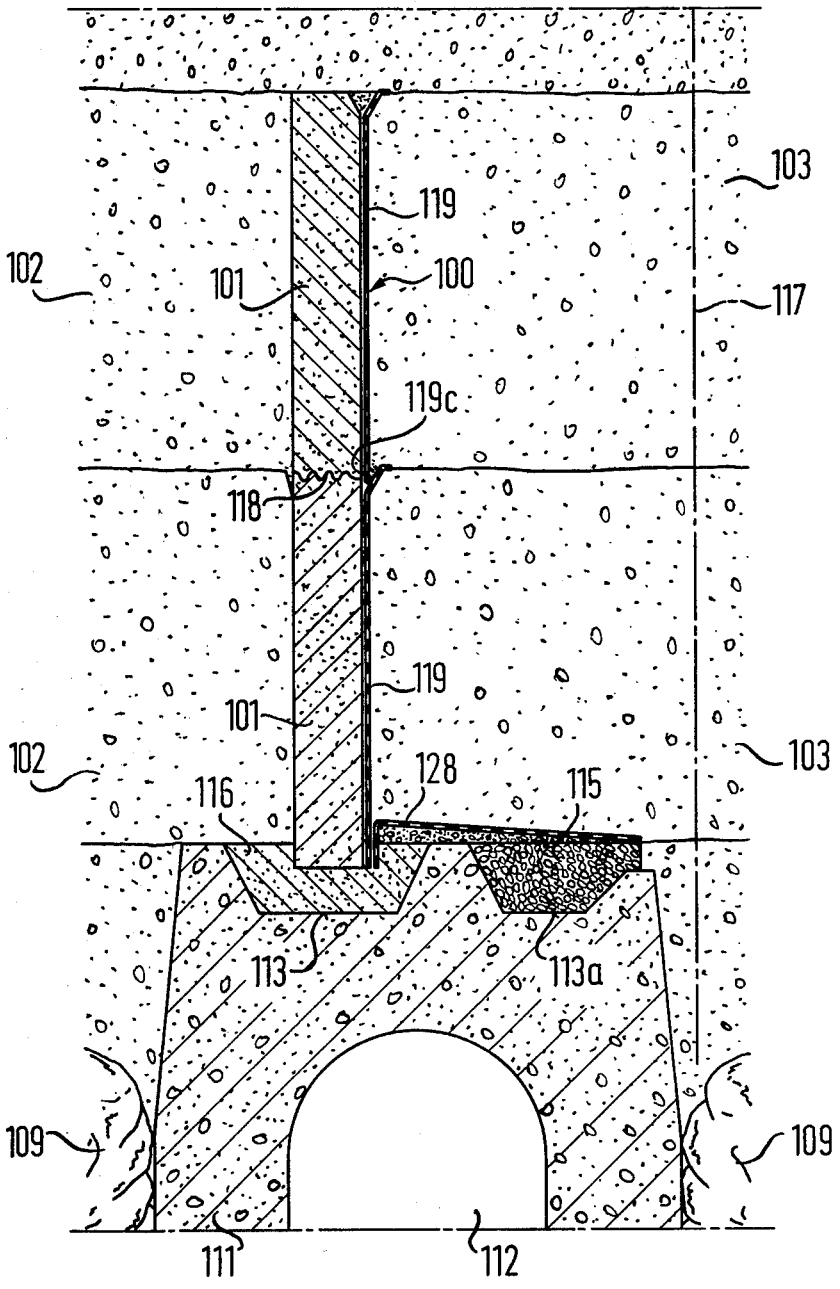
FIG. 8 shows a slightly modified portion of the dam of FIG. 7 on a larger scale.
Figure 10A:
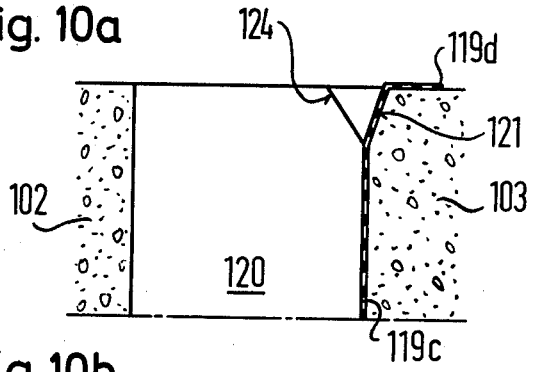
Figure 10B:
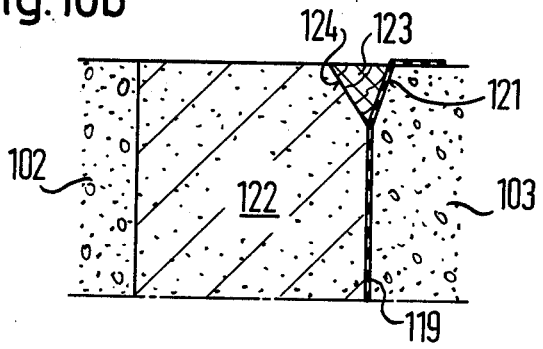
Figure 11:
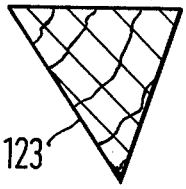
Figure 12:
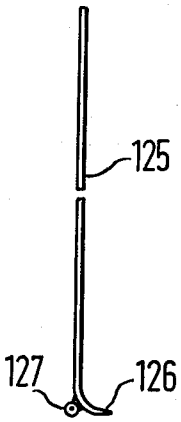
Figure 10D:
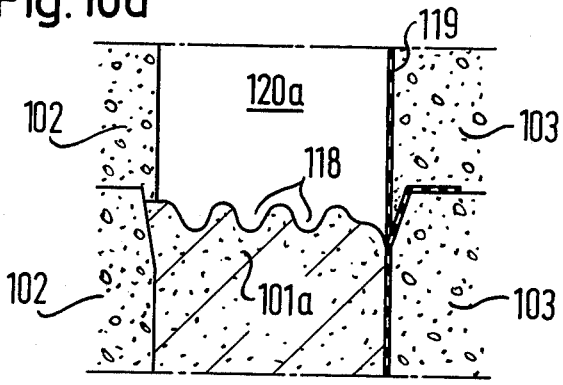

FIGS. 10*a* to 10*d* illustrate sequential stages of construction of the dam of FIG. 8 in respective fragmentary, greatly enlarged, side-elevational views;

FIG. 11 illustrates a wooden core for use in the procedure of FIGS. 10*a* to 10*d* in a corresponding view; and FIG. 12 shows apparatus for use in building the structure of FIG. 8 in side elevation.

Figure 1:
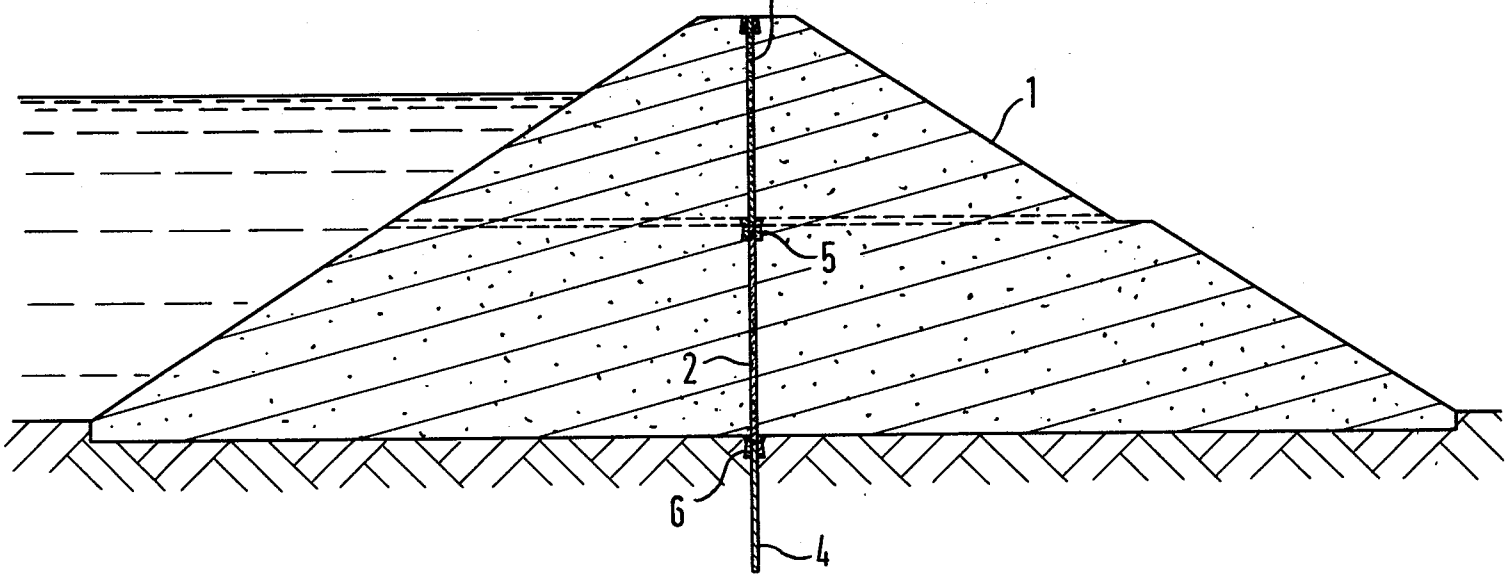
FIG. 1 shows an earth-fill dam of the invention retaining a body of water in side-elevational section.

Referring now to the drawing in detail, and initially to FIG. 1, there is shown an earth-fill dam 1 of the invention whose impervious core is constituted by two abuttingly, superimposed, plate-shaped wall sections 2, 3 standing on edge. Each wall section has a height of almost 30 meters. An additional wall section 4 is buried upright in the ground under the dam. It rests on bedrock, and its top edge carries the lowermost wall section 2 of the core. The dam foundation of the dam consisting of underlying ground, bedrock, and the wall section 4 is practically impervious to water. The buried section 4 may be omitted if the ground and rock under the dam is adequately impervious. A joint assembly 5 connects the parts of the major, vertical wall faces on the sections 2, 3. It impedes, but does not prevent, relative angular displacement of the sections 2, 3. A similar joint assembly 6 connects the sections 2, 4.

In constructing the dam shown in FIG. 1, the section 4 was installed, and earth fill was dumped on the construction site to the approximate height of the joint assembly 5 which extends over the width of the dam at right angles to the plane of FIG. 1. The fill was permitted to settle and was additionally rolled in a manner known in itself. A trench extending over the width of the dam was then excavated to the top of the wall section 4 in the fill material, and the vertical sides of the upper, wider trench portion were lined with downwardly flaring guide walls 10, 11 of reinforced concrete, as is shown in FIG. 2. Upright channels 26 spaced along the guide walls 10, 11 provided support for form walls 23, 24 of wooden boards defining the cavity 20 in which a cement mixture for the wall section 2 was to be poured.

As is best seen in FIG. 4, the form walls 23, 24 were suspended from the top edges of the guide walls 10, 11 by means of horizontal angle irons 27 or loops 30 of steel wire resting on the tops of the associated guide walls 10, 11 and attached to respective channels 26. The channels 26 and the form walls 23, 24 fastened to the channels 26 by bolts 28 were hooked over the guide walls 10, 11 by means of short vertical angle irons 25 welded to the horizontal angle irons 27 or by corresponding wooden posts 29 engaged by the wire loops 30. The pouring of the wall section 2 will presently be described with reference to FIG. 6.

Figure 3:
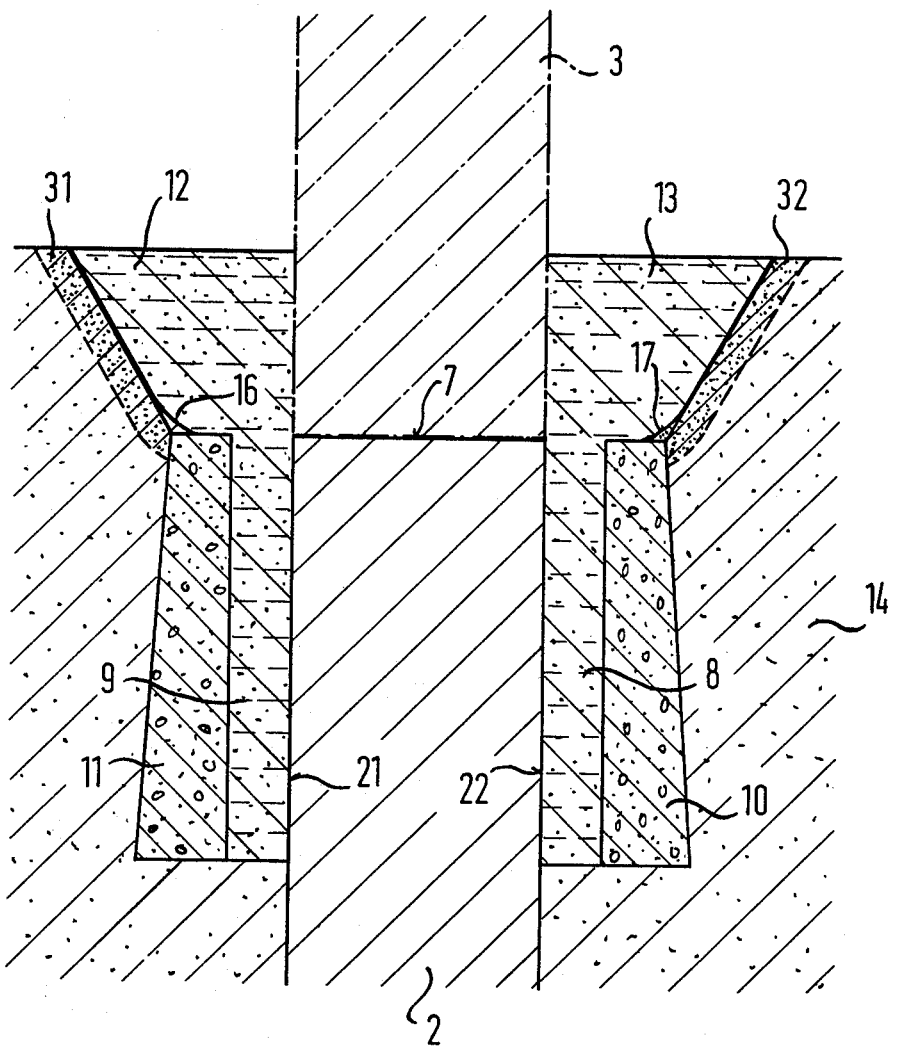
FIG. 3 illustrates the incomplete dam in a later stage of construction and in the manner of FIG. 2.

After the wall section 2 was poured and had solidified sufficiently, the form walls 23, 24 together with the associated channels 26 were removed from the trench, and the cavities between the guide walls 10, 11 and the newly erected wall section 2 were filled with slabs 8, 9 of a tough, yieldable material as is shown in FIG. 3. As is inherent in the afore-described method of preparing the form for the wall section 2, its major, upright faces 21, 22 were parallel to corresponding faces of the guide walls 10, 11 so that the slabs 8, 9 were rectangular in cross section.

The thickness of each slab 8, 9 was 20 cm, or not more than 1% of the height of the wall section 3 intended to be installed later, whereas the height of each slab was 1.30 m or between preferred values of 4– 5% of the height of the wall section 3. The guide walls 10, 11 had a smallest thickness of 20 cm at their top edges and a thickness of 30 cm at their bottom edges.

A layer of further fill 14 was then dumped above the top edges of the guide walls 10, 11, the slabs 8, 9, and the wall section 2 and excavated to define obliquely flaring sides of portions 12, 13 of a trough on either side of the intended location of the wall section 3 shown in phantom view in FIG. 3. The layers 31, 32 of earth fill 14 on the oblique trough sides were reinforced with pneumatically sprayed concrete, and a coating of sprayed concrete was applied to the wall surfaces and rounded the corners 16, 17 between the side and bottom walls of the trough. The trough between the sides 31, 32 was filled with the same permanently plastic, tough material from which the slabs 8, 9 had been made. After setting of the tough material, it was excavated to provide space for the subsequently poured wall section 3.

The trough sides 31, 32 had a slope of about 60° relative to the horizontal and had a height of 90 cm or 3% of the height of the wall section 3. The bottom of each trough portion 12, 13 had a width slightly smaller than the combined widths of the associated slab 8, 9 and guide wall 10, 11 or approximately 40 cm, and the trough communicated directly with the associated slab so that the material filling the trough portions 12, 13 in area contact with the wall sections 2, 3 and constituting the slabs 8, 9 permitted limited relative movement of the wall sections 2, 3 relative to their planar and horizontal interface 7.

Figure 5:
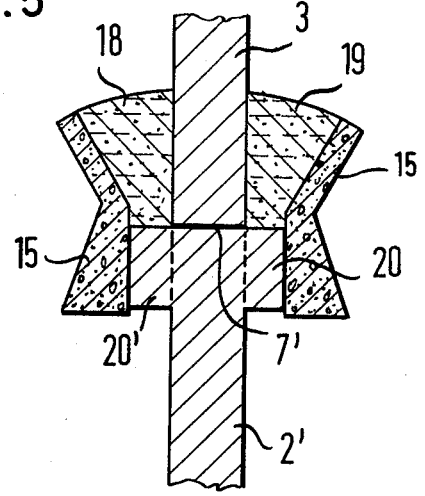
FIG. 5 is a fragmentary, side-elevational, sectional view of a modification of the structure shown in FIG. 3.

An alternative joint assembly between wall segments 2', 3 is shown in FIG. 5. The earth fill, not shown, on either side of the lower wall section 2' carries concrete liners 15 which are vertically coextensive with the bottom edge portion of the wall section 3 and the top edge portion of the wall section 2'. Each liner 15 has the approximate cross-sectional shape of a wide V whose lower leg has a surface approximately parallel to the aligned major faces of the wall sections while the upper leg flares away from the wall section 3. The apex of the V-shape is near the planar and horizontal interface 7' of the wall sections. An integral bead or flange 20' on the top edge portion of the wall section 2' downwardly bounds troughs 18, 19 between the wall section 3 and the upper legs of the liners 15, the troughs being filled with the afore-mentioned tough, yielding material which resists, but does not prevent, relative angular displacement of the wall sections 2', 3.

The bead or flange 20' was poured after the wall section 2' in a form arrangement similar to that shown in FIG. 3. After the removal of the wooden form walls 23, 24, reinforcing steel rods projecting upward from the guide walls 10, 11 were bent obliquely outward along the trough sides 31, 32 and covered with sprayed concrete mixture (Gunite) to form the upper legs of the liners 15 whose lower legs were constituted by the guide walls 10, 11. The cavities between the guide walls 10, 11 and the wall section 2' were filled with soil-cement to form the bead or flange 20'.

The elasticity of the wall section material under compressive stress is chosen similar to that of the surrounding fill of the dam. Its elasticity under compressive stress, therefore, should be between about 500 kp/cm$^2$ and 1000 kp/cm$^2$. The preferred material of construction for the wall sections is soil-cement whose permeability constant $k$ (Darcy) has a value of approximately $10^{-3}$ m/sec.

The tough, yielding material constituting the slabs 8, 9 and filling the troughs 12, 13, 18, 19 should preferably have a compressive strength of about 2 to 4 kp/cm$^2$ and an elasticity under compressive stress of less than about 500 kp/cm$^2$. Its water permeability value $k$ (Darcy) should be smaller than $10^{-3}$ m/sec. It may consist of sand, Portland cement, a pore filler of very small particle size, such as bentonite, clay flour or stone flour, and optionally 1 to 3% of a synthetic resin binder. A composition that has been used successfully consisted of:

| | |
|---|---|
| Synthetic resin binder (polyvinyl chloride, styrene acrylic ester copolymer, polybutadiene) | 2% |
| Bentonite | 3 – 5 % |
| Portland cement | 15% |
| Sand | Balance |

Another tough, but yieldable material for use in the joint assemblies 5, 6 may consist of:

| | |
|---|---|
| Synthetic resin binder (polyvinyl chloride, styrene acrylic ester copolymer, polybutadiene) | 0 – 2% |
| Clay flour or stone flour | 10 – 15% |
| Portland cement | 15% |
| Sand | 68 – 75% |

all percentage values being by weight on a dry basis.

When the wall section 2 or 2' was set sufficiently, additional earth fill 14 was dumped on the lower dam portion previously constructed to provide sufficient height for another trench in which the wall section 3 could be poured.

Figure 6:
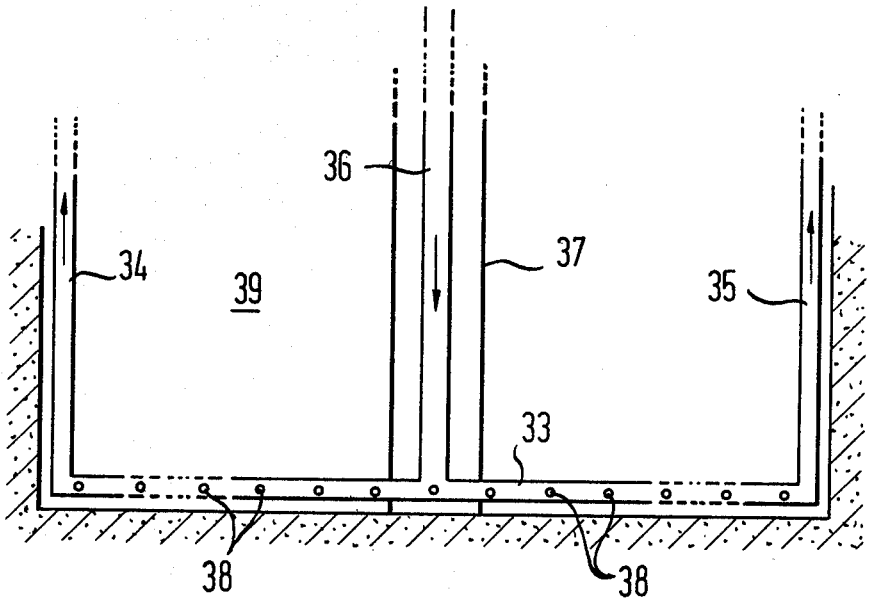
FIG. 6 shows another portion of the dam of FIG. 1 at a stage of construction preceding that illustrated in FIG. 2 in front-elevational section.

The mold for the lower wall section 2 is partly bounded by the form walls 23, 24, as described with reference to FIG. 2, but over most of its height by exposed, practically vertical faces 39 of the earth fill 14, as is shown in FIG. 6. Before soil-cement mixture or other suitable slurry is poured into the trench, the trench is filled with an aqueous 5% bentonite suspension. To avoid the trapping of the liquid by the subsequently poured soil-cement and the ensuing, potentially fatal weakening of the solidified and cured wall section, a horizontal pipe 33 having multiple openings 38 is placed along the bottom over the entire length of the excavated trench. Hoses 34, 35 lead upward and out of the trench from the two ends of the pipe 33. Another vertical conduit 36 is connected to the center of the tube 33. A jacket 37 spacedly envelops the conduit 33.

The soil-cement slurry is poured into the non-illustrated top of the jacket 37, and the jacket is gradually withdrawn upward as the soil-cement builds up in the trench and displaces the bentonite suspension. When the outer orifices of the openings 38 are covered with soil-cement, additional cement slurry is poured into the conduit 36 to displace the bentonite suspension from the manifold pipe 33 through the hoses 34, 35. The hoses may then be withdrawn, or they may be left in the poured wall section 2. The pipe 33 remains in the section and reinforces its lower edge. The wall section 3 is poured in an analogous manner in earth fill dumped atop the wall section 2 and excavated to provide a mold whose bottom is closed by the joint assembly 5, as the joint assembly 6 may close the mold shown in FIG. 7 if a buried wall section 4 is provided.

The bentonite suspension mentioned above with reference to FIG. 6 is employed most successfully with an earth fill whose exposed faces 39 have a water permeability value $k$ (Darcy) smaller than $10^{-5}$ m/sec., so that they are practically impermeable to the suspension. This condition is met, for example, by a mixture of sand, gravel, and rock in which particles of 60 microns and less predominate. The fill must be of adequate stability to permit excavation of a trench having vertical sides, the sides remaining upright at least until the bentonite suspension provides temporary support.

Figure 7:
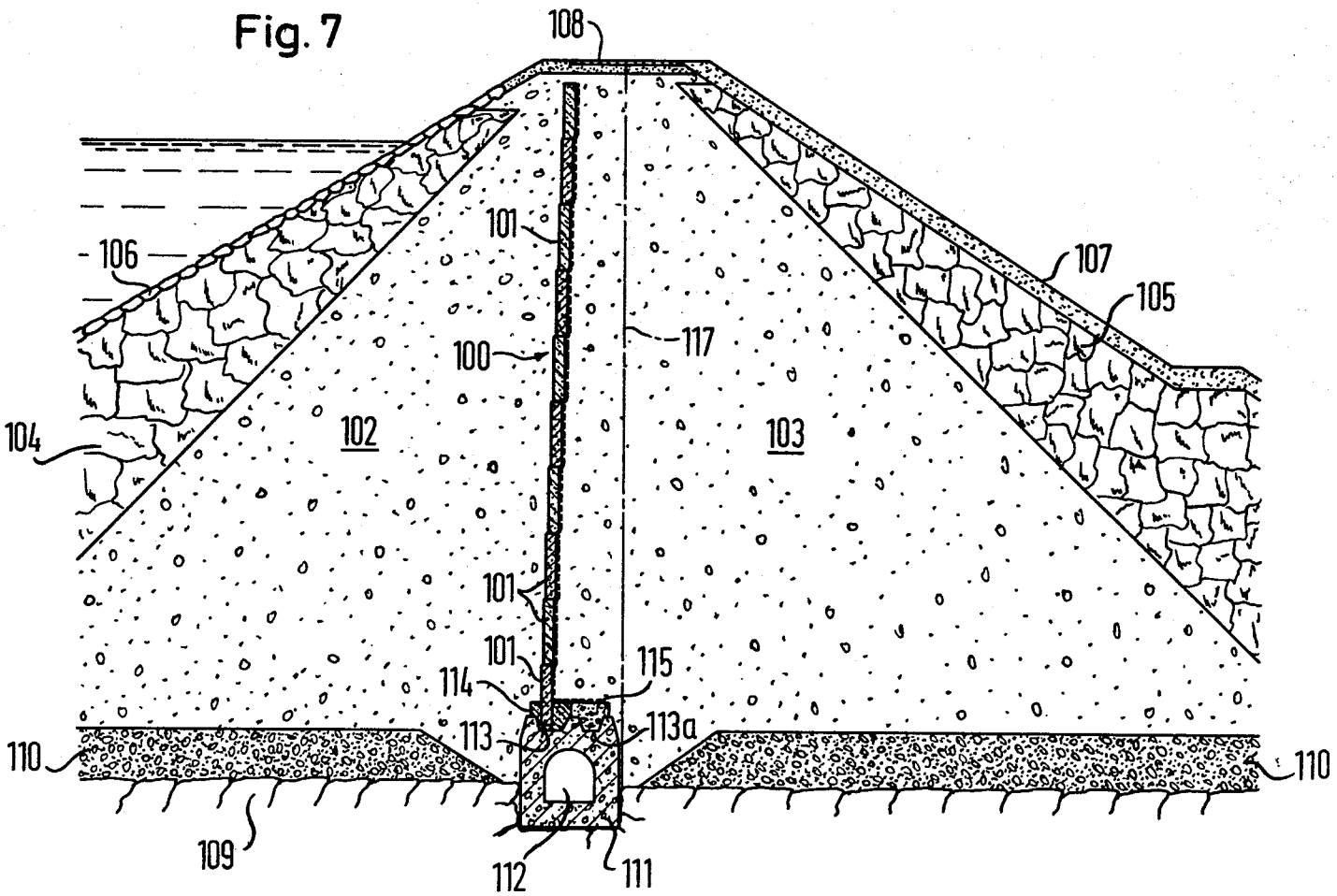
FIG. 7 shows another earth-fill dam of the invention in side-elevational section.

FIG. 7 shows another dam of the invention which may be built without resorting to bentonite suspension or the like in the construction of its impervious central core 100 for pouring its ten horizontally elongated wall sections 101 which are superposed in upright, edge-to-edge relationship. The core 100 is arranged between upstream earth fill 102 and downstream earth fill 103 and offset in an upstream direction from the median plane 117 of the dam. A layer 104, 105 of dumped rock fill covers the slopes of the fill bodies 102, 103. The rocks on the upstream side are further protected by cut and placed stones 106 whereas the rock layer on the downstream side is covered with a layer 107 of top soil. The top of the dam is flattened and provided with a traffic surface 108 wide enough for vehicular traffic.

The fill bodies 102, 103 consist of locally excavated soil permitting digging of a trench whose walls will not collapse for a limited period, but which is not impervious to water. This requires the presence of 2 – 5% fines having a particle size of 60 microns or less in a mixture otherwise consisting of sand and gravel. They rest on respective layers 110 of coarse gravel placed on an impervious rock and soil foundation 109 and separated by a reinforced concrete foundation 111, partly recessed in the rock and soil 109 and supporting the impervious core 100.

The foundation 111 is hollow and its normally dry interior provides a walkway 112 from which the dam may be inspected through windows, not shown. Two grooves **113, 113*a* extend side by side over the length of the dam in the top of the foundation 111. The bottom edge of the lower-most wall section 101 is received in the upstream groove 113. A body 114 of the aforedescribed, tough, yieldable material fills the remainder of the groove 113 and projects upward beyond the flaring side walls of the groove to constitute a hinged, though somewhat stiff connection between the foundation 111 and the core 100. A filter layer 115 of coarse gravel fills the groove 113*a***.

A similar connection between the lowermost wall section 101 and the foundation 111 is provided in the modified structure shown in FIG. 8 by a body 116 of soil-cement occupying most of the groove 113, the bottom edge of the lowermost wall section 101 being embedded in the upper third of the soil-cement. The desired, increased plasticity of the soil-cement in the body 116 is brought about by a suitable bentonite content.

The soil-cement constituting the wall sections 101 is prepared from 10% dry clay flour, 5% Portland cement, the balance being sand, whereas the body 116 is made from a soil-cement prepared from 10% dry clay flour, 5% Portland cement, and 2% bentonite, the balance being sand, all percentage values being by weight. The clay, Portland cement, and bentonite in these compositions may be varied by ±25%, and a small amount of synthetic resin binder, up to about 3%, may replace a corresponding weight of sand, as is conventional in itself. The exact composition of the soil-cement in the wall sections 101 is chosen to match the material of the fill bodies 102, 103. The sand employed preferably includes a relatively wide variety of particle sizes and contains at least 2 – 5% raw clay having a $k$ value of less than $1 \times 10^{-6}$ m/sec.

A soil-cement mixture that has been found to combine desirable properties for a wall section under many conditions has been prepared from 1331 kg sand, 153 kg clay flour, and 90 kg cement per cubic meter. The bulk density of the mixture is 1,600 kg per cubic meter. When mixed with 400 liters water per cubic meter, it forms a slurry capable of being pumped and weighing 2,000 kg/m$^3$. The need for slightly more or less water is determined by testing the spreadability of the mixture.

The individual wall sections 101 may typically have a height of 3.20 m and a thickness of 0.60 m. They are joined by interengaged grooves and ribs 118. After the soil cement of each wall section 101 is poured, and before it fully solidifies, grooves are formed in its top edge by means of suitable tools, such as the teeth on an excavator bucket. The next higher wall section 101 is poured into a mold whose bottom is constituted by the grooved top edge of the next lower section 101. Ribs and grooves are thereby molded into the bottom edge of the higher section 101 whose top edge in turn is grooved by means of the excavator bucket. The several wall sections 101 are mechanically interengaged in joints which are practically as watertight as the material constituting the wall sections.

Figure 9:
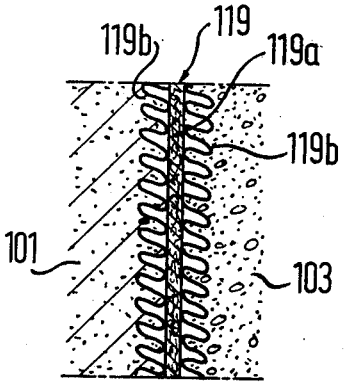
FIG. 9 shows a modification of the structure of FIG. 2 in a greatly enlarged, fragmentary view.

While the soil-cement sections 2, 3, 101 by themselves provide a core which is adequately impervious to water in most dams, it is preferred to supplement the wall sections by filter webs 119 arranged between the upright major faces of respective wall sections 101 and the downstream body 103 of earth fill as is shown in FIG. 8 and on a much larger scale in FIG. 9 which illustrates corresponding structure in the dam 1 illustrated in FIG. 1. Each filter web includes a mat **119*a* of durable synthetic fibers, such as polyamide and polyester fibers. A nap 119*b* of coarse, looped threads of the same synthetic materials is formed on each surface of the mat 119*a* by means of a needling machine. In an actual embodiment of the filter web 119, the mat had a thickness of 11 mm, and the nap of protective thread loops 119*b*** had a thickness of 3 mm, as measured from each surface of the mat.

The thread loops of the nap **119*b* integrally connect the web 119 on one side with the soil-cement of the wall section 101 and on the other side with the body 103 of earth fill. The thread loops 119*b* separate the filter mat 119*a*** from the earth fill and maintain the permeability of the filter web to water from the upstream side of the web.

While the impervious cores in the dams of the invention not normally exposed to settling stresses in the fill which would cause the immediate formation of cracks, the formation of fine cracks in the core cannot be prevented forever. If water finds a path through a cracked wall section, it entrains fine, particulate material from the wall which gradually clogs the pores in the filter web 119 near the crack. The velocity of the water passing through the crack is thereby reduced, and fines are deposited from the water not only on the filter web 119, but also in the discharge orifice of the crack. The crack is ultimately sealed by fines carried from elsewhere in the wall section toward the discharge orifice.

Particulate material fine enough to be carried by a minimal amount of water at relatively low velocity through a narrow and normally tortuous channel is not normally present in the upstream fill body and must be derived from the soil cement of the wall sections. The self-healing effect described above cannot be achieved by a filter web on the upstream face of the core. Such a web could not prevent the gradual enlargement of a crack in the core.

The specific gravity of polyamide and polyester fibers, the preferred materials for the filter web of the invention, is greater than that of water, being 1.38 in an actual embodiment of the invention, so that the filter web sinks in water. The last-mentioned filter web weighed 1100 g per square meter and had a tear resistance of 100 kg after 30% stretching in a test according to German Industrial Standard DIN 53858.

Because of its permeability, the web 119 is a permanently effective filter and ensures pressure release by water drainage, whereby the upstream body of earth fill is relieved of stress.

A filter web 128 of the same material as the web 119 is provided at the lower end of the core 100. It is embedded in the body 116 of soil cement filling the groove 113 in overlapping engagement with the web 119 covering the downstream face of the lowermost wall section 101 and generally slopes obliquely downward and downstream over the layer 115 of gravel in the groove 113*a*, a thin layer of fine gravel being interposed between the relatively coarse filter gravel 115 and the web 128.

The construction of a dam including the core 100 is partly illustrated in FIGS. 10*a* to 10*d*. The dam is built in successive horizontal layers of 25 – 35 cm which are individually dumped and consolidated by rolling. After a height of approximately three meters is reached, a trench 120 having vertical sides is excavated to a depth sufficient to expose the top edge of a previously built wall section. The top of the downstream side of the trench is beveled at an angle of 15° – 50°, the illustrated angle of 20° relative to the vertical being preferred for the bevel surface 121.

The bottom and sides of the trench, particularly the downstream side and its beveled portion, are carefully cleaned by means of a tool shown in FIG. 12. The tool consists of a thin-walled tube 125 having a length of 4.50 m and a diameter of about 2.5 cm. The bottom end of the tube is offset in an arc of about 90° and terminates in a restricted nozzle 126 horizontally elongated at right angles to the plane of the drawing. A wheel 127 is rotatably mounted on the convex bight of the tube 125 and permits the nozzle 126 to be moved along the trench bottom and sides. Air pumped into or drawn from the top end of the tube 125 causes loose dust particles to be dislodged and removed from the trench.

A filter web 119 is draped over the downstream side of the trench 120 so that its lower end 119*c* reaches the bottom of the trench and the upper end 119*d* rests on the exposed top surface of the earth fill 103, as is shown in FIG. 10*a*. A triangular wooden bar 123 is secured on the portion of the filter web 119 which covers the bevel surface 121, the angles in the cross section of the bar 123 being chosen so that the top of the secured bar is horizontal and flush with the earth fill at this stage, and the third face 124 of the bar slopes inward of the trench 120 in an upward direction at an angle of 15° – 45° to the vertical, the illustrated slope of 30° being preferred. The height and width of the bar 123 are each 15 cm.

Figure 10C:
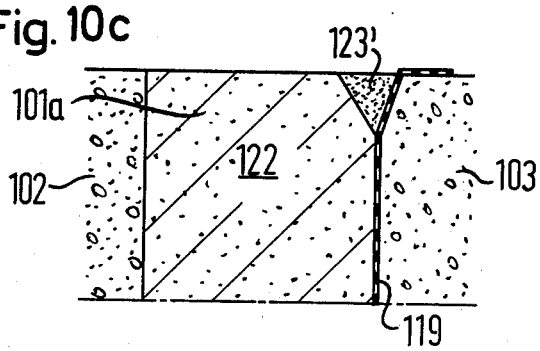

The available space of the trench 120 is then filled with soil-cement mixture 122 as is shown in FIG. 10*b*, and the bar 123 is removed after the cement mixture sufficiently solidifies. The resulting groove 123' is filled with sand or fine gravel, as is shown in FIG. 10*c*, to prevent entry of earth fill and coarse fragments into the groove during the subsequent formation of grooves 118 in the cement mixture and the continued build-up of the fill bodies 102, 103 to an additional height of about 3 m in the manner described above. A trench 120*a* is excavated in the last-dumped layer, the web 119 being protected from damage by the excavating tools by the sand or gravel in the groove 123'. The groove 123' is cleared of sand or gravel by means of the tool shown in FIG. 12 before another filter web 119 is placed in the trench 120*a* and the cycle of operations is repeated, starting from the condition shown in FIG. 10*d* in which the soil cement mixture 122 is practically fully cured to constitute a wall section 101*a*. The newly installed web 119 is sealed to the previously installed web by the pressure of the newly poured cement mixture in a lap joint.

When the several wall sections 101 are poured seqentially in the manner described above, settling of the earth fill is at least 30 to 50% complete, and the subsequent settling rate is low enough to avoid transmission of significant shear stresses to the core 100. The cured soil-cement is sufficiently plastic to permit a linear deformation of 5% without formation of cracks. The soil-cement cures adequately within 20 hours not to suffer damage from the dumping of additional fill.

While the invention has been described with reference to impermeable cores of plate-shaped wall sections embedded in earth fill, the use of rock fill, dumped or rolled, is specifically contemplated. It is necessary for such rock fill, however, to permit a trench having vertical walls to be excavated, and the excavation walls may require support in a manner known in itself if the rock fill does not possess the stability necessary for the build-up of a soil-cement core from sequentially poured amounts of soil-cement slurry.

It should be understood, of course, that the foregoing disclosure relates only to preferred embodiments of the invention, and that it is intended to cover all changes and modifications in the examples of the invention herein chosen for the purpose of the disclosure which do not constitute departures from the spirit and scope of the invention set forth in the appended claims.

What is claimed is:

1. A retaining dam for a body of water comprising:

(a) a foundation substantially impervious to water;

(b) a plate-shaped core extending upward from said foundation, (1) said core being substantially impervious to water and having two vertically extending major faces, (2) said core including a plurality of superposed wall sections and joint means connecting each section to a superposed section for limited pivotal movement, (3) each section having two opposite faces and a horizontally extending face connecting said opposite faces and abuttingly engaging a corresponding face of another wall section, said opposite faces of said sections jointly constituting said major faces, (4) each joint means including a body of tough, yieldable material engaging in area contact one of the opposite faces of each wall section and the corresponding face of the superposed wall section; and (c) particulate fill resting on said foundation and covering said major faces and said joint means.

2. In a method of constructing a retaining dam for a body of water which includes depositing particulate fill on a foundation impervious to water, excavating a trench in said fill to said foundation, and sequentially building a plurality of plate-shaped wall sections in said trench, each wall section being built by pouring an aqueous slurry into said trench, the solids in said slurry consisting essentially of particulate fill material and an amount of Portland cement sufficient to cause spontaneous solidification of said slurry, the slurry to constitute a lower-most section being poured on the top edge portion of a previously poured and solidified section, the improvement which comprises:

(a) erecting two guide walls in said trench in spaced relationship prior to the building of one of said sections;

(b) releasably securing an upright form wall to each guide wall, said form walls spacedly facing each other, said guide walls and form walls having respective top edge portions located on a common level;

(c) pouring an amount of said slurry into said trench to fill the space between said form walls to said common level;

(d) removing said form walls after said solidification of said slurry to constitute said one section, whereby cavities are formed between said one section and said guide walls;

(e) filling said cavities with a tough, yieldable material;

(f) erecting trough walls on the top edge portion of said guide walls, said trough walls diverging upward from the respective guide walls to constitute a trough downwardly bounded by said one section and said tough yieldable material;

(g) filling said trough with an additional amount of said tough yieldable material;

(h) forming a groove in said additional amount; and (i) partly forming another section by filling said groove with said slurry.

3. In a method of constructing a retaining dam for a body of water which includes depositing particulate fill on a foundation impervious to water, excavating a trench in said fill to said foundation, and sequentially building a plurality of plate-shaped wall sections in said trench, each wall section being build by pouring an aqueous slurry into said trench, the solids in said slurry consisting essentially of particulate fill material and an amount of Portland cement sufficient to cause spontaneous solidification of said slurry, the slurry to constitute a lower-most section being poured on the top edge portion of a previously poured and solidified section, the improvement which comprises:

(a) erecting two guide walls in said trench in spaced relationship prior to the building of one of said sections;

(b) releasably securing an upright form wall to each guide wall, said form walls spacedly facing each other, said guide walls and form walls having respective top edge portions located on a common level;

(c) pouring an amount of said slurry into said trench to fill the space between said form walls to said common level;

(d) removing said form walls after said solidification of said slurry to constitute said one section, whereby cavities are formed between said one section and said guide walls;

(e) filling said cavities with an additional amount of said slurry;

(f) erecting trough walls on the top edge portions of said guide walls, said trough walls diverging upward from the respective guide walls to constitute a trough downwardly bounded by said one section and the solidified additional amount of slurry;

(g) filling said trough with a tough, yieldable material;

(h) forming a groove in said tough, yieldable material; and (i) partly forming another section by filling said groove with said slurry.

4. In a method of constructing a retaining dam for a body of water which includes depositing particulate fill on a foundation impervious to water, excavating a trench in said fill to said foundation, and sequentially building a plurality of plate-shaped wall sections in said trench, each wall section being built by pouring an aqueous slurry into said trench, the solids in said slurry consisting essentially of particulate fill material and an amount of Portland cement sufficient to cause spontaneous solidification of said slurry, the slurry to constitute a lower-most section being poured on the top edge portion of a previously poured and solidified section, the improvement which comprises: filling said trench prior to said pouring with an aqueous liquid, and displacing said liquid by feeding slurry to the lowermost portion of said trench.

5. A dam as set forth in claim 1, wherein said fill is less impervious to water than said foundation and said core.

6. A dam as set forth in claim 1, further comprising joint means connecting the lowermost wall section of said foundation for limited pivotal movement.

7. A dam as set forth in claim 1, wherein said tough, yieldable material has a compressive strength of about 2 to about 4 kp/cm$^2$, an elasticity value under compressive stress smaller than about 500 kp/cm$^2$, and a permeability value $k$ according to Darcy smaller than about $10^{-3}$ meter per second.

8. A dam as set forth in claim 7, wherein said tough, yieldable material consists essentially of sand as the predominant component, enough Portland cement to provide said compressive strength, a finely particulate pore filler in an amount sufficient to provide said permeability value, and 1 to 3 percent by weight of a synthetic resin binder.

9. A dam as set forth in claim 1, wherein said core consists essentially of a material having an elasticity value under compressive stress between about 500 and 1000 kp/cm$^2$, said value being similar to the corresponding value of said fill.

10. A dam as set forth in claim 9, wherein said material is a soil-cement having a permeability value $k$ according to Darcy smaller than $10^{-9}$ meter per second.

11. A dam as set forth in claim 1, wherein the portion of said fill contiguously adjacent said major faces has a permeability value $k$ according to Darcy smaller than about $10^{-5}$ meter per second.

12. A dam as set forth in claim 1, wherein said core consists essentially of soil-cement including 7.5 to 12.5% pore filler, 3.75 to 6.25% Portland cement, 0 to 3% synthetic resin binder, the balance being sand, said pore filler being a water insoluble particulate material having a particle size smaller than said sand, said percentage values being by weight on a dry basis.

13. A method as set forth in claim 2, wherein said fill is deposited on said foundation in successive layers, and respective vertical portions in said trench are sequentially excavated in said layers, said common level being located vertically adjacent an exposed surface of one of said layers, an additional layer of said fill being deposited on said one layer and said filled trough, and a portion of said trench is excavated in said additional layer to said additional amount of tough, yieldable material prior to said filling of said groove with said slurry.

14. A method as set forth in claim 4, wherein the portions of said fill bounding said trench have a water permeability value $k$ according to Darcy smaller than about $10^{-5}$ meter per second.

* * * * *